US010358886B2

(12) United States Patent
Mattey

(10) Patent No.: US 10,358,886 B2
(45) Date of Patent: Jul. 23, 2019

(54) LOAD TRANSFER PROFILE

(71) Applicant: OneSubsea IP UK Limited, London (GB)

(72) Inventor: Alexander Jose Jesus Mattey, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/423,742

(22) Filed: Feb. 3, 2017

(65) Prior Publication Data

US 2017/0350208 A1 Dec. 7, 2017

Related U.S. Application Data

(60) Provisional application No. 62/346,698, filed on Jun. 7, 2016.

(51) Int. Cl.
*E21B 33/038* (2006.01)
*E21B 33/068* (2006.01)
*E21B 34/04* (2006.01)

(52) U.S. Cl.
CPC ..... *E21B 33/038* (2013.01); *E21B 33/068* (2013.01); *E21B 34/04* (2013.01)

(58) Field of Classification Search
None
See application file for complete search history.

(56) References Cited

U.S. PATENT DOCUMENTS

| | | | | |
|---|---|---|---|---|
| 4,751,968 A * | 6/1988 | Ames | E21B 33/043 | 166/206 |
| 5,066,048 A | 11/1991 | Farrell | | |
| 5,299,643 A * | 4/1994 | Vetter | E21B 33/043 | 166/115 |
| 6,672,396 B1 * | 1/2004 | Marroquin | E21B 33/035 | 166/348 |
| 7,798,231 B2 * | 9/2010 | Ford | E21B 33/038 | 166/337 |
| 8,973,664 B2 * | 3/2015 | Yates | E21B 33/035 | 166/341 |

* cited by examiner

*Primary Examiner* — Matthew R Buck
*Assistant Examiner* — Douglas S Wood
(74) *Attorney, Agent, or Firm* — Brandon S. Clark

(57) ABSTRACT

A load transfer profile for connection of two bodies without preloading uses a horizontal force couple instead of a vertical force couple for maximum efficiency. The load transfer profile includes a series of tapers and/or diameters that create a radial force couple separated by an axial distance. In particular, the load transfer profile includes at least a first horizontal contact and a second horizontal contact, where each contact is a landing shoulder followed by a stop shoulder or a radial protrusion. The first and second horizontal contacts are offset by the axial distance to accommodate a force-determined bending moment such that system structural fatigue capacity is optimized. A lock mechanism assists with resisting axial loads without creating preload stresses and with locking the bodies together.

16 Claims, 8 Drawing Sheets

$M_reaction = F1*D$ $M'_reaction = F1*D'$

LOAD TRANSFER PROFILE

CROSS-REFERENCE TO RELATED APPLICATION

This application claims priority to and benefit of U.S. Provisional Patent Application No. 62/346,698, entitled "LOAD TRANSFER PROFILE," filed Jun. 7, 2016, which is herein incorporated by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In the oil and gas industry, a well may be drilled and a completion system may be installed at a surface end of the well in order to extract oil, natural gas, and/or other subterranean resources from the earth and/or to inject substances downhole. Such a completion system may be located onshore or subsea, depending on the location of the desired resource and/or well. A completion system generally includes a wellhead assembly through which a resource is extracted or fluids are injected.

Various mechanisms exist for connecting bodies or tubulars, including but not limited to mechanisms which can be set by weight or to a desired preloaded condition such as described in U.S. Pat. No. 5,066,048, which is incorporated by reference herein in its entirety. Such mechanisms include, for example, a rigid lockdown system, a landing-and-locking ring, expanding split ring, split lock ring, split load ring, C-ring, and similar mechanisms. One type of existing connection system uses an axial force couple by means of weight set or preloaded condition (to provide a rigid lockdown) to connect cylindrical bodies or tubulars, for example a wellhead housing within a conductor housing, to withstand such forces. Another type of connection system uses a passive lockdown mechanism, which requires a split lock ring being biased outwardly such that when an inner tubular is landed within an outer tubular, the split lock ring will set into place and provide the lockdown of the inner tubular to the outer tubular.

However, in the above examples, static and dynamic load capacities are dependent upon the preload created between concentrically placed cylindrical bodies or tubulars in a wellhead system. This typically creates pre-yielding of components and limits the corresponding static and dynamic load capacities. In order to increase the dynamic and static load capacities in these cases, an increase of the inner and outer diameters for the mating cylinders or tubulars is required, which can increase cost and may also preclude commercial applicability in some instances.

BRIEF DESCRIPTION OF THE DRAWINGS

For a detailed description of embodiments of the present disclosure, reference will now be made to the accompanying drawings in which.

DETAILED DESCRIPTION

Figure 1:
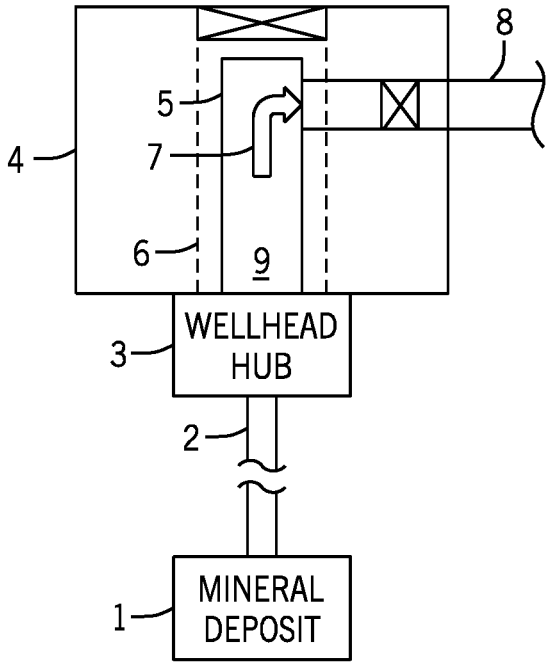
FIG. 1 is a schematic of a mineral extraction system.

One or more specific embodiments of the present disclosure will be described below. These described embodiments are only exemplary of the present invention. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

This discussion is directed to various embodiments of the disclosure. The drawing figures are not necessarily to scale. Certain features of the embodiments may be shown exaggerated in scale or in somewhat schematic form, and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure and claims, the articles "a," "an," "the," and "said" are intended to mean that there are one or more of the elements. The terms "comprising," "including," and "having" are used in an open-ended fashion, and thus should be interpreted to mean "including, but not limited to . . . " Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

The present disclosure relates to a load transfer profile that makes use of a horizontal force couple instead of a vertical force couple for maximum efficiency. The load transfer profile of the present disclosure locks two bodies or tubulars together actively; it does not require a weight-set or preloaded condition (rigid lockdown mechanism). The load transfer profile of the present disclosure also does not require an increase of the inner and outer diameters of concentric tubulars in order to secure the tubulars to withstand static and dynamic loads encountered during operations, such as for example well drilling, completion, or production operations. In its various embodiments, the load transfer profile of the present disclosure may be used in a variety of applications and industries in which it may be necessary to connect bodies or tubulars one inside another, side by side, or in another configuration of connection, while providing higher load capacity than is available using known techniques.

For example, in a subsea or surface well, wellhead system equipment typically features cylindrical bodies which contact and rest in larger cylindrical bodies. A typical wellhead system includes a conductor housing and a wellhead housing that supports one or more casing hangers and is able to withstand static and dynamic loads, for example the static and dynamic loads presented by flow control equipment such as a blowout preventer (BOP) or a tree. Static loads includes without limitation bending, tension, torsion, and shear. During dynamic loading, bending corresponds to fatigue in performance. Dynamic capacity refers to fatigue performance after a bending moment, tension, and/or shear loads are applied, as a function of the number of cycles during a period of time.

FIG. 1 is a schematic of an exemplary mineral extraction system configured to extract various natural resources, including hydrocarbons (e.g., oil and/or natural gas), from a mineral deposit 1. Depending on where the natural resource is located, the mineral extraction system may be land-based (e.g., a surface system) or subsea (e.g., a subsea system). The illustrated system includes a wellhead assembly coupled to the mineral deposit or reservoir 1 via a well. Specifically, a wellbore 2 extends from the reservoir 1 to a wellhead hub 3 located at or near the surface.

The illustrated wellhead hub 3, which may be a large diameter hub 3, acts as an early junction between the well and the equipment located above the well. The wellhead hub 3 may include a complementary connector, such as a collet connector, to facilitate connections with the surface equipment. The wellhead hub 3 may be configured to support various strings of casing or tubing that extend into the wellbore, and in some cases extending down to the mineral deposit 1.

The wellhead assembly generally includes devices and components that control and regulate activities and conditions associated with the well. For example, the wellhead assembly may include what is known in the industry as a Christmas tree assembly 4, or tree designed to route the flow of produced minerals (e.g., produced flow) from the mineral deposit 1 and the wellbore 2 to the surface, to regulate pressure in the well, and to facilitate the injection of chemicals into the wellbore 2 (e.g., downhole). Christmas trees 4 are typically an assemblage of valves, flow paths, and access points employed to monitor, control, and service the well.

As described above, the present disclosure relates to systems and methods for coupling cylindrical bodies or tubulars together, where the load between the cylindrical bodies is transferred in a horizontal or radial direction. It should be appreciated the load transfer profiles described herein may be applied to any connection between two tubulars, including for example casing hanger to casing string, wellhead to wellhead casing, conductor to conductor casing, and so forth. FIG. 1 illustrates an embodiment of two cylindrical bodies that are coupled together, where a first cylindrical body includes a tubing spool tree 4 (e.g., horizontal tree or spool tree) that supports a second cylindrical body including a hanger 5 (e.g., a tubing hanger or a casing hanger).

The illustrated tubing spool tree 4 has a frame disposed about a body, which cooperate to support various components and define various flow paths for operating the well. For example, the tubing spool tree 4 has a spool bore 6 that is in fluid communication with the well and that facilitates completion and workover operations, such as insertion of tools, landing of hangers 5, and injection of chemicals "downhole" into the well, to name just a few.

Minerals extracted from the well (e.g., oil and natural gas) are routed (arrow 7) from the spool bore 6 and into a production flow bore, which in the illustrated embodiment is a horizontal production flow bore 8 or wing bore. The horizontal production flow bore 8 is in fluid communication with a tubing hanger bore 9 that is fluidly connected to the wellbore 2. Produced minerals may flow from the wellbore 2, through the tubing hanger bore 9 and/or spool bore 6, and through the production fluid bore 8. Conversely, the various bores 2, 6, 8, 9 can be used to inject fluids and materials into the well, and can be used as access points for workover and completion activities.

To control and regulate flow in and out of the well, the tubing spool tree 4 carries various valves—e.g., ball valves, gate valves—in fluid communication with the flow paths defined by the above-described bores (e.g., 2, 6, 8, 9).

Figure 2A:
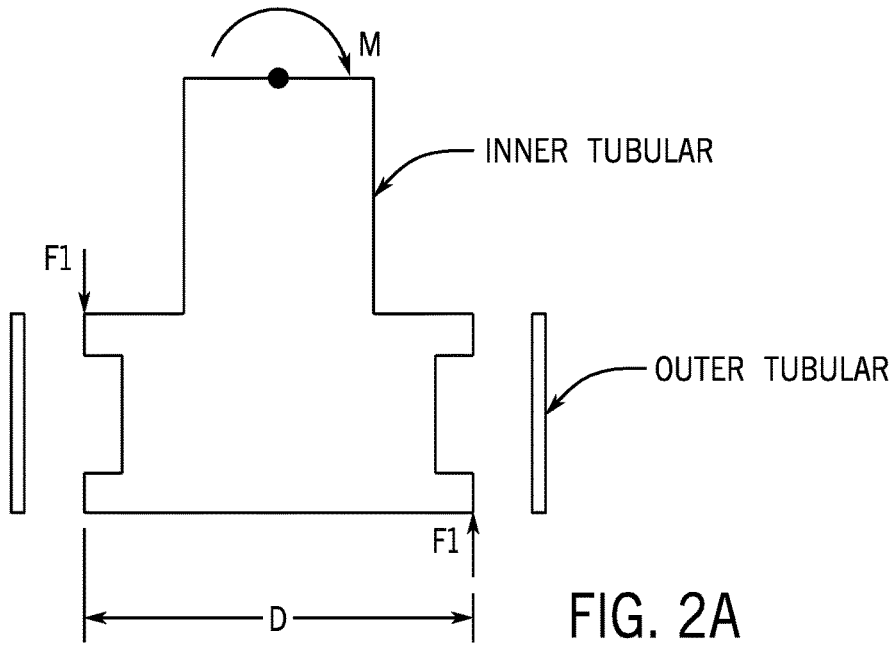
FIGS. 2A and 2B depict schematic diagrams of certain variable relationships with respect to a known system and a system of the present disclosure.
Figure 2B:
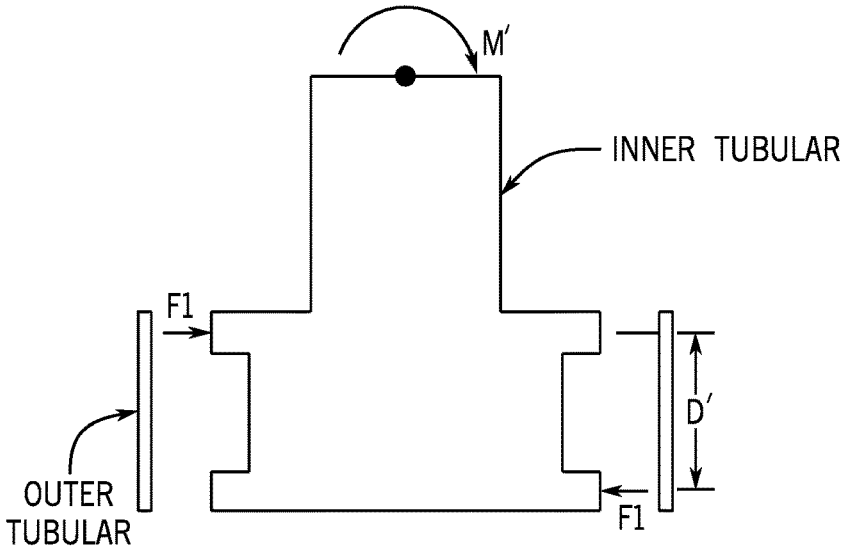

FIGS. 2A and 2B present a schematic comparison of the relationships of certain variables with respect to a known axial preloaded system (FIG. 2A) and lateral contact using a load transfer profile of the present disclosure (FIG. 2B). Both FIGS. 2A and 2B schematically depict a system in which an inner tubular is located within an outer tubular. FIG. 2A schematically depicts a force F1 applied in two opposing vertical or axial directions, thereby creating an axial force couple F1-F1 and a bending moment M. The horizontal or radial design dimension D (here, the maximum outer diameter of the inner tubular) is proportional to the bending moment M in order to accommodate the generating vertical or axial force couple F1-F1. FIG. 2B schematically depicts the same force F1 applied in two opposing horizontal or radial directions, thereby creating a horizontal or radial force couple F1-F1 and bending moment M'. The vertical or axial design dimension D' (here, the distance between radial contacts, discussed further below) is proportional to the bending moment M' in order to accommodate the generating horizontal or radial force couple F1-F1. Because the radial protrusions and distance D' therebetween are used to address the force couple, and because the force couple is not aligned with the axial direction of the bodies or tubulars, the load transfer profile of the present disclosure frees the inner and outer tubulars from sizing requirements in order to accommodate bending moment M'.

Known subsea wellhead systems having a rigid lockdown through an axially preloaded mechanism depend on the tubular diameters to withstand the loads imposed during installation and drilling operations. The relatively large sizing requirements for tubular diameters require in some cases a complex system to lock an inner high pressure housing (HPH) (for example a wellhead housing) inside an outer low pressure housing (LPH) (for example a conductor housing). The high concentration stresses within such complex lock systems limit the fatigue and structural performance of the wellhead system. In order to increase the structural and fatigue performance of the wellhead system, the load transfer profile of the present disclosure moves the load path between the HPH and LPH to a horizontal or radial (non-axial) force couple. The horizontal force couple removes dependency on tubular diameter D and transfers it to the distance D' between the radial contacts of the force couple (discussed further below).

While the illustrated embodiments describe load transfer profiles in terms of cylindrical bodies or inner and outer tubulars having axial and radial (or vertical and horizontal) directions, and connected concentrically i.e. one inside of the other, it should be appreciated that the load transfer profile of the present disclosure is equally applicable to bodies of other shapes, regular and irregular, and connections of other relative orientation and type, including but not limited to indirect connections and connections of other adjacent bodies such as nonconcentric side-by-side bodies, for example.

Figure 3:
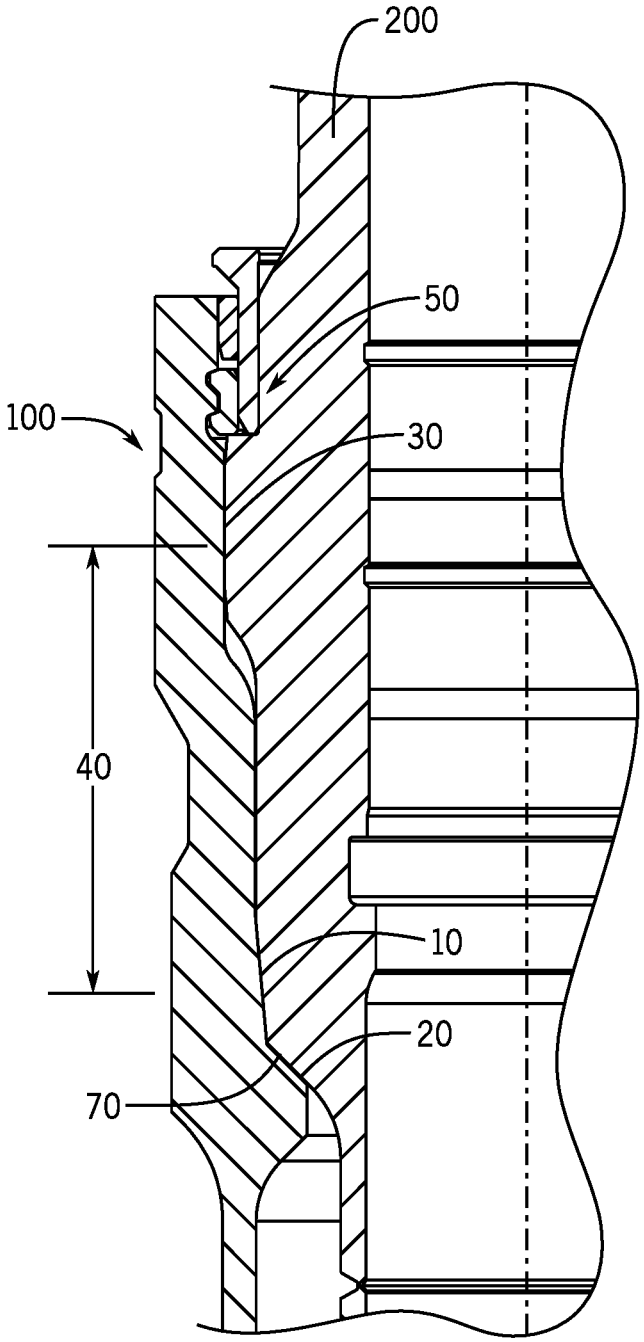
FIG. 3 depicts a cross-sectional view of a load transfer profile for a connection system in accordance with one or more embodiments of the present disclosure.

Referring now to FIG. 3, a cross-sectional view of a load transfer profile for a tubular connection system in accordance with one or more embodiments of the present disclosure is shown. The load transfer profile includes a series of tapers and diameters that create a radial force couple separated by an axial distance to enhance the structural and fatigue performance of the tubular connection system without depending on larger tubular diameters.

An inner tubular 200 is shown within an outer tubular 100. The outer tubular 100 may be, for example, a conductor housing, a low pressure housing (LPH), and/or any other outer component for connection to an inner component. Similarly, the inner tubular 200 may be, for example, an internal housing, a wellhead housing, a high pressure housing (HPH), and/or any other inner component for connection to an outer component, and may be designed to fit a mandrel or other component within its own interior. It should be appreciated that while the outer tubular 100 is shown as a low pressure housing and the inner tubular 200 is shown as a high pressure housing of a wellhead system in the illustrated embodiments, the inner and outer components for connection can be any tubular body, i.e. the load transfer profile of the present disclosure can be used for any connection between two tubulars, including for example casing hanger to casing string, wellhead to wellhead casing, conductor to conductor casing, and so forth.

As shown in FIG. 3, in some embodiments, a first horizontal contact is created in the load transfer profile of a wellhead by a lower landing shoulder 10 on the inner tubular 200 that creates a radial load sufficient to hold the inner and outer tubulars 200 and 100, respectively, in place. The landing shoulder 10 may be tapered, sloped, or angled, for example in a range from 0 to 90 degrees, 1 to 30 degrees, 2 to 20 degrees, 3 to 15 degrees, or 0 to 10 degrees from a vertical axis, and may be a jamming taper. An inner surface 70 of the outer tubular 100 may include a taper, slope, or angle that corresponds to or is a mirror image of the tapered landing shoulder 10.

The landing shoulder 10 is followed by a hoop load limiter shoulder or stop shoulder 20. The stop shoulder 20 may be tapered, sloped, or angled, for example in a range from 0 to 90 degrees, 10 to 70 degrees, or 30 to 60 degrees from a vertical axis. The stop shoulder 20 limits the hoop stresses on the outer tubular 10 at the radial interference contact 10 with the inner tubular 200, can limit overstretching of the outer tubular 100, and/or absorb landing loads. The inner surface 70 of the outer tubular 100 may include a taper, slope, or angle that corresponds to or is a mirror image of at least a portion of the stop shoulder 20.

The second horizontal contact to complete the force couple is created with an upper pivoted bump, ring, or other protrusion 30. Both the landing shoulder 10 and the protrusion 30 may be integral to or distinct from the inner tubular 200. The vertical or axial distance 40 between horizontal or radial contacts 10 and 30 is set such that system structural fatigue capacity is optimized, i.e., failure (if any) would occur not within the system itself but outside of the interaction of tubulars 100 and 200. In some embodiments, the axial distance 40 may be measured between a first center point of a first upper radial contact (e.g., shoulder 10, protrusion 30) and a second center point of a second lower radial contact (e.g., shoulder 10, protrusion 30). A lock mechanism 50 can assist with resisting axial loads, including those due to thermal expansion, without creating preload stresses as well as locking the tubulars together. The lock mechanism 50 also can assist with landing and setting inner tubular 200 within outer tubular 100 on the tapered landing shoulder 10.

Figure 4:
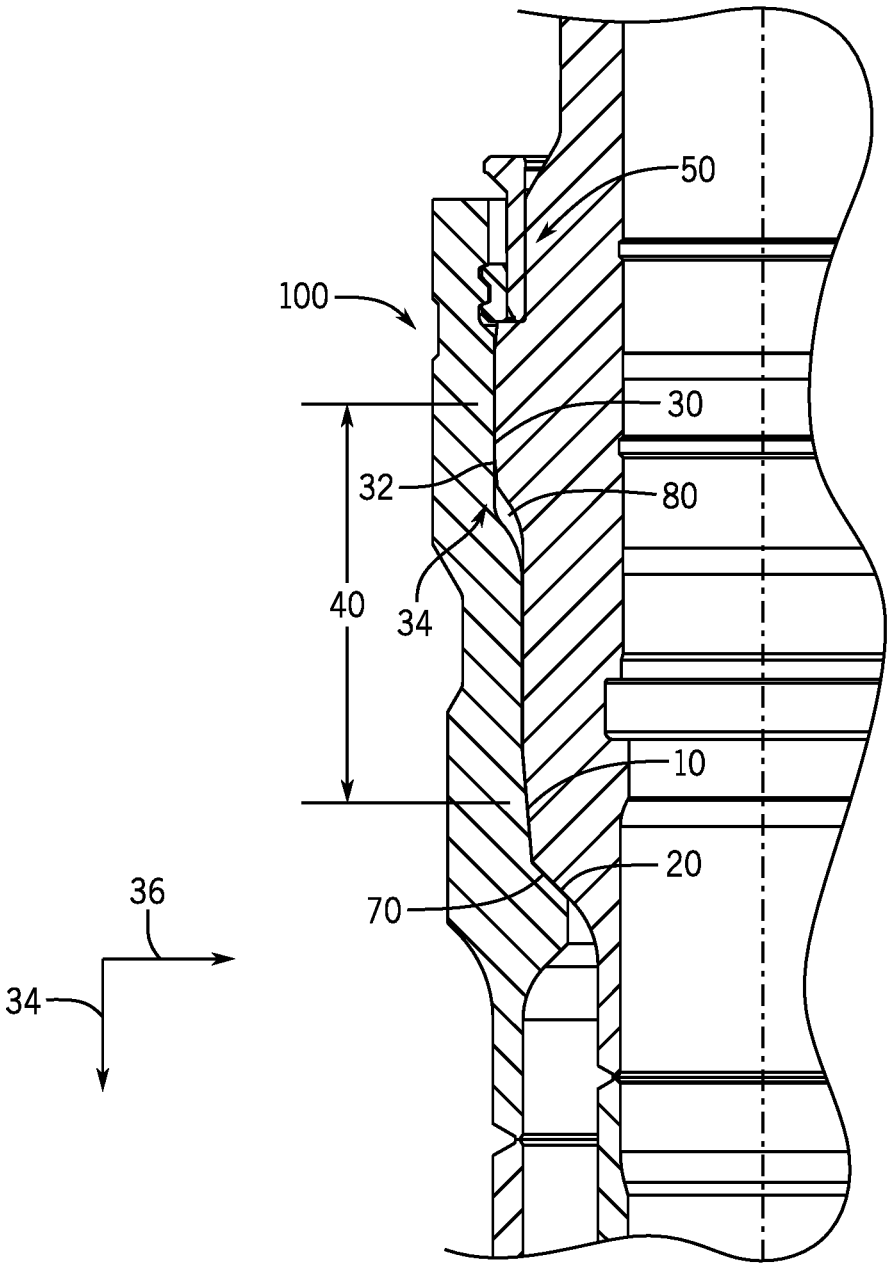
FIG. 4 depicts a close-up cross-sectional view of an embodiment of the load transfer profile of FIG. 3.

FIG. 4 depicts a close-up cross-sectional view of the embodiment of the load transfer profile of FIG. 3. An axial space 80 (e.g., annular volume) is formed along the axial distance 40 between the outer tubular 100 and the inner tubular 200. The axial space 80 may begin at or approximately at an inner most axial end 32 of the protrusion 30 (e.g. the upper radial contact). The axial space 80 may extend in an axial direction 34 along a portion of the axial distance 40. The shape of the axial space 80 may vary based in part on the shape of the protrusion 30 (e.g., the upper radial contact), as described in further detail below.

In some embodiments, the axial space 80 may be longer in the axial direction 34 than in a radial direction 36 or vice versa. As the axial space 80 increases in axial length, the bending capacity of the outer tubular 100 and the inner tubular 200 also increases. The axial space 80 may range from $^{5}/_{1000}{}^{th}$ to $^{50}/_{1000}{}^{th}$ of an inch (0.0127 centimeters (cm) to 0.127 cm), $^{10}/_{1000}{}^{th}$ to $^{40}/_{1000}{}^{th}$ of an inch (0.254 cm to 0.102 cm), $^{20}/_{1000}{}^{th}$ to $^{30}/_{1000}{}^{th}$ of an inch (0.051 cm to 0.076 cm), and all lengths there between. Moreover, the axial space 80 may be between 0.2 to 2%, 0.4 to 1%, 0.6 to 0.75%, and all percentages there between of the axial distance 40 between the upper radial contact and the lower radial contact.

The possibility of preloading the inner tubular and the outer tubular may increase when the axial distance 40 exceeds a target distance. In accordance with certain embodiments, the target distance of the axial distance 40 that may be utilized to avoid preloading of the tubulars may range from approximately 0.457 m to 1.524 m (approximately 1.5 feet to 5 feet) and all lengths there between.

The protrusion 30 may contribute to the bending resistance of the cylindrical bodies (e.g., the inner tubular 200 and the outer tubular 100) thereby reducing fatigue of the cylindrical bodies and increasing performance. In the illustrated embodiment, the protrusion 30 of the inner tubular 200 may be substantially parallel to an axis of the outer tubular 100. The protrusion 30 may be cylindrical in shape and may extend annularly around the inner tubular 200. As described above, the inner most axial end 32 of the protrusion 30 may partially define the shape of the axial space 80. For example, the axial end 32 of the protrusion 30 may not contact the outer tubular 100 at a position 34, and the axial space 80 may begin at the position 34 (i.e., where the protrusion 30 is not in contact with the outer tubular 100). Directly below the axial space 80, the inner tubular 200 may continuously contact the inside the outer tubular 100 or periodically contact the inner outer tubular 100 as the inner tubular 200 moves (e.g., rocks back and forth in the radial direction 36).

The stop shoulder 20 may contribute to the axial resistance of the tubulars. In the illustrated embodiment, the stop shoulder 20 may be acutely angled to the protrusion 30. The stop shoulder 20 may have a slight taper (e.g., approximately 1 to 10 degrees, 2 to 8 degrees, 4 to 6 degrees, and all ranges there between) and may extend annularly around the inner tubular 200.

Figure 5:
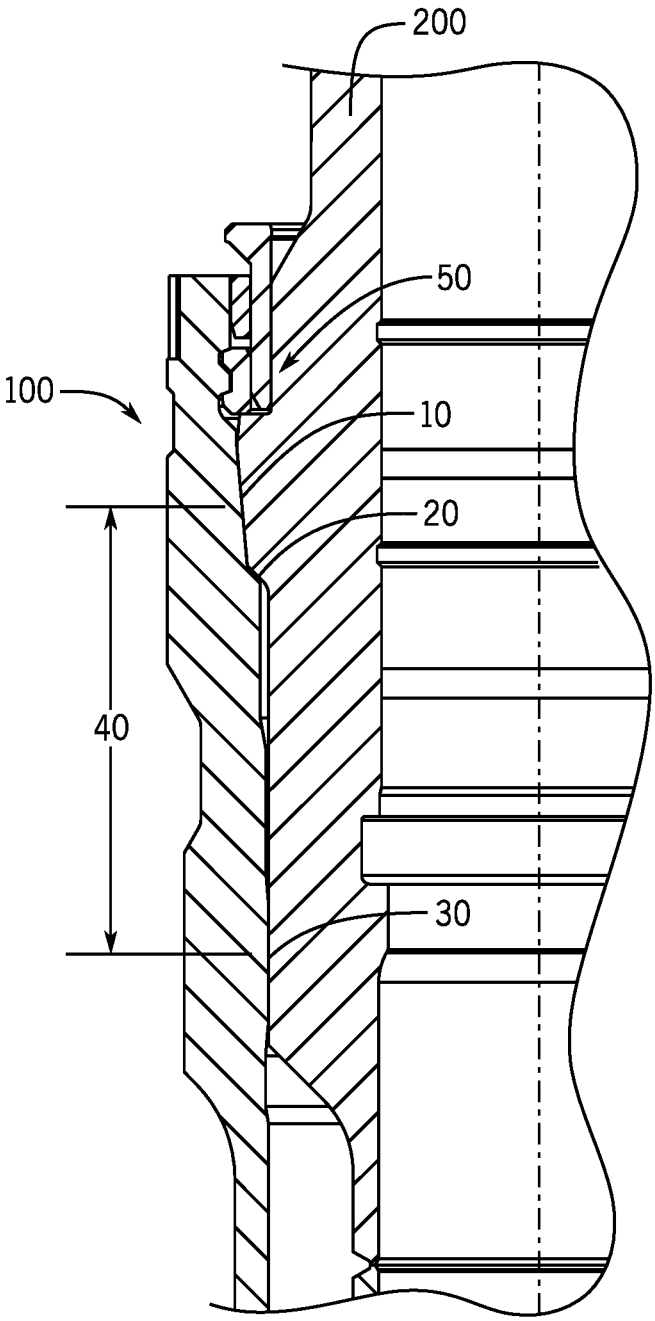
FIG. 5 depicts a cross-sectional view of a load transfer profile for a connection system in accordance with one or more embodiments of the present disclosure.

Referring now to FIG. 5, in embodiments, the tapered landing shoulder 10 and hoop load limiter shoulder or stop shoulder 20 may be located at an upper end, and the radial pivoted bump, ring, or other protrusion 30 may be located below. The distance 40 between the radial contacts of the force couple, as well as the lock mechanism 50, are the same as previously described with respect to FIGS. 3-4.

Figure 6:
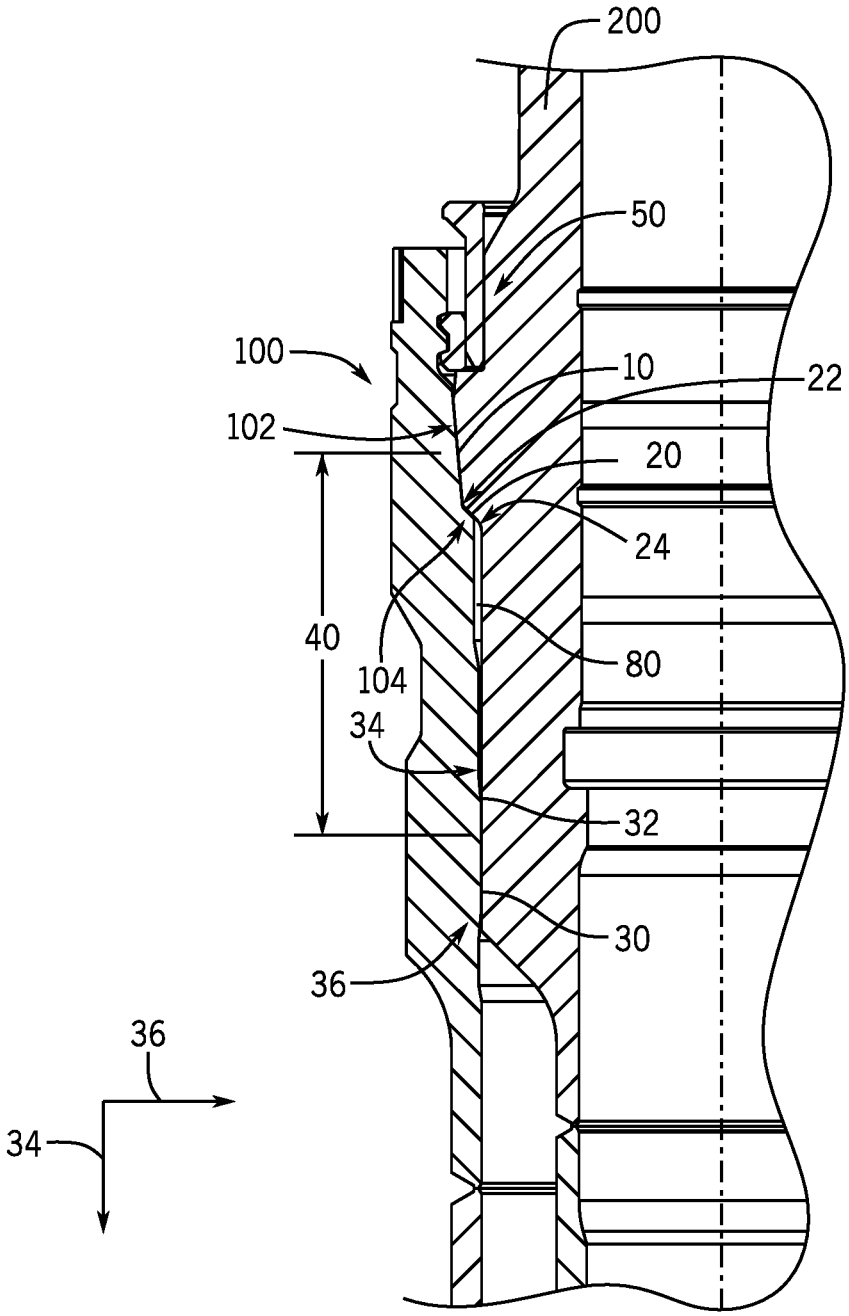
FIG. 6 depicts a close-up cross-sectional view of an embodiment of the load transfer profile of FIG. 5.

FIG. 6 depicts a close-up cross-sectional view of the embodiment of the load transfer profile of FIG. 5. In the illustrated embodiment, an outer surface 102 of the landing shoulder 10 contacts a first inner surface 102 of the outer tubular 100 in its entirety. An outer surface 22 of the stop shoulder 20 contacts a second inner surface 104 of the outer tubular 100 until a position 24. At the position 24, the stop shoulder 22 ceases contact with the outer tubular 100. The position 24 defines an upper axial portion (e.g., boundary) of the axial space 80. As illustrated, the axial space 80 is substantially longer in the axial direction 34 when compared to the embodiment of the load transfer profile described with reference to FIGS. 3-4. The stop shoulder 20 may be acutely tapered relative to the lower radial contact.

The lower radial contact (e.g., the protrusion 30) may be cylindrical in shape and may extend annularly around the inner tubular 200. The protrusion 30 may be substantially parallel to an axis of the outer tubular 100. As described above, the inner most axial end 32 of the protrusion 30 may partially define the shape of the axial space 80. For example, the axial end 32 of the protrusion 30 may not contact the outer tubular 100 at a position 34, and the axial space 80 may begin to narrow at the position 34 (i.e., where the protrusion 30 is not in contact with the outer tubular 100). As described above with reference to FIGS. 3-4, the inner tubular 200 may continuously contact the inside of the outer tubular 100 or periodically contact the inner outer tubular 100 as the inner tubular 200 moves (e.g., rocks back and forth in the radial direction 36). In the illustrated embodiment, the lower radial contact (e.g., the protrusion 30) may also have a second position 36 where the inner tubular 200 does not contact the outer tubular 100.

Figure 7:
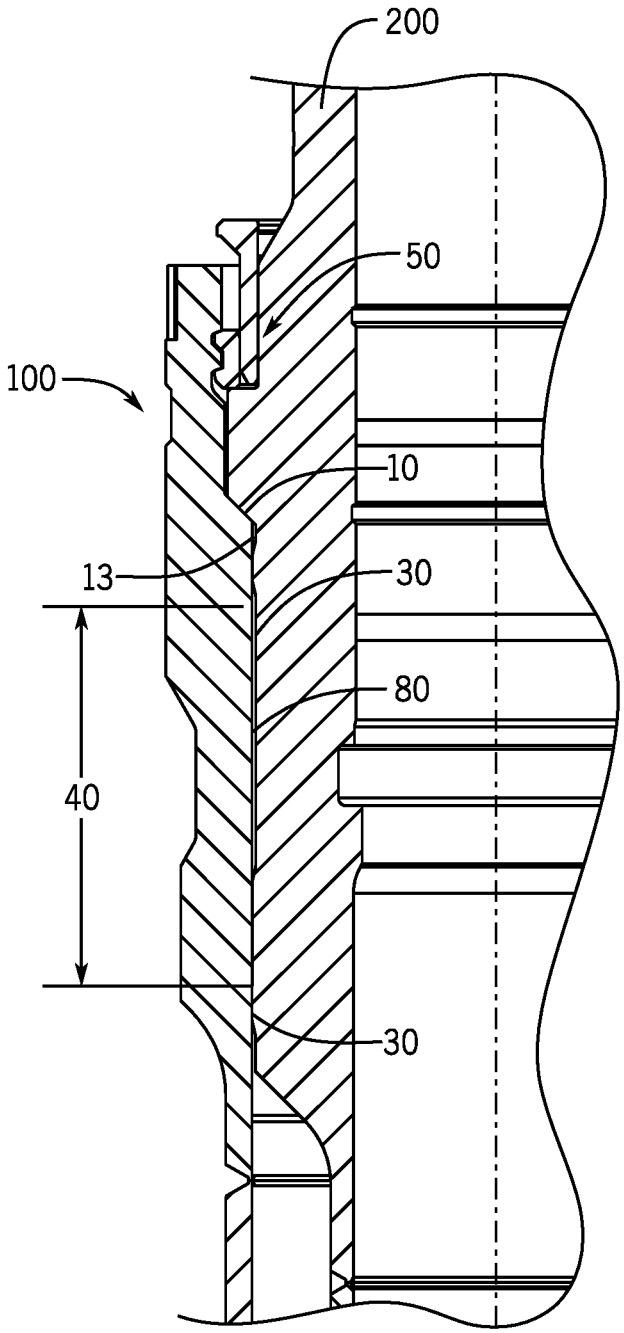
FIG. 7 depicts a cross-sectional view of a load transfer profile for a connection system in accordance with one or more embodiments of the present disclosure.

In embodiments, as shown in FIG. 7, the force couple is created using a tapered landing shoulder 10 for landing the inner tubular 200 and two pivoted bumps, rings, or protrusions 30. The optimal distance 40 between protrusions 30 shown in FIG. 7, like the distance 40 between protrusion 30 and landing shoulder 10 shown in FIGS. 3 and 5, can be determined based on the predicted or desired bending moment, as described with reference to FIG. 2. In embodiments, the distance 40 can be greater than one-half of the outer diameter (i.e. greater than the radius) of the inner tubular 200. For example, the distance 40 can be 1.5, two, three, four, five, six, seven, eight, nine, or ten or more times the radius of the inner tubular 200.

The two protrusions 30 shown in FIG. 7 may have the same geometry or a different geometry from each other. Additional embodiments of the present disclosure may include more than two protrusions, for example three, four, five or more protrusions, without regard to whether the load transfer profile also includes a landing shoulder 10.

The distance 40 between the radial contacts of the force couple is the same as previously described with respect to FIGS. 3 and 5. Although lock mechanism 50 of FIG. 7 (unlike the embodiments of FIGS. 3 and 5) plays no role in landing or setting inner tubular 200 within outer tubular 100, lock mechanism 50 of FIG. 7 assists with resisting axial loads, including those due to thermal expansion, without creating preload stresses as well as locking the tubulars together.

Figure 8:
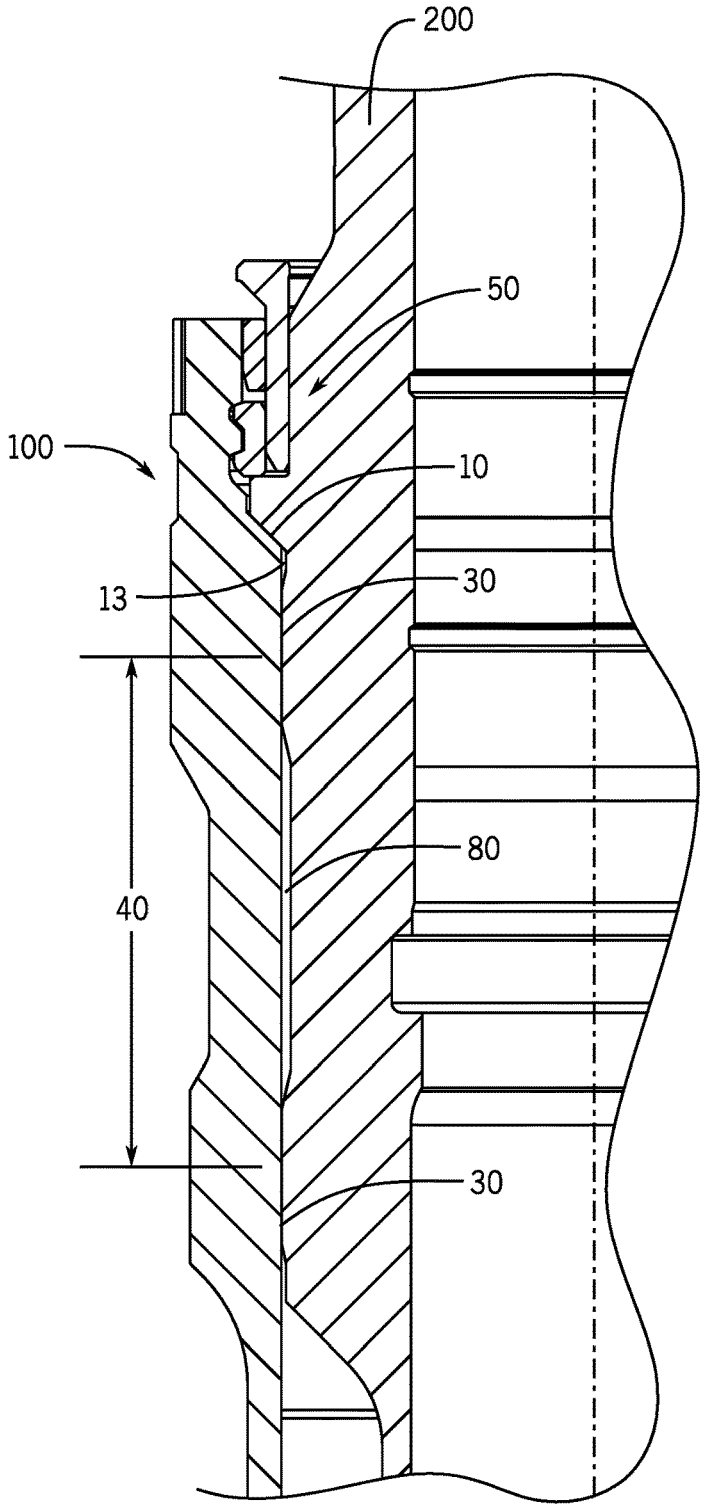
FIG. 8 depicts a close-up cross-sectional view of an embodiment of the load transfer profile of FIG. 7.

FIG. 8 depicts a close-up view of the embodiment of the load transfer profile of FIG. 7. In the illustrated embodiment, the upper radial contact (e.g., the upper protrusion 30) and the lower radial contact (e.g., the lower protrusion 30) are substantially parallel to each other and a central axis of the inner tubular 200. The upper radial contact and the lower radial contact are both cylindrical and extend annularly around the inner tubular 200. Above the upper radial contact, a small pocket 13 may be present to receive any debris or other matter that may be present on the landing shoulder 10 may be displaced. The inner tubular 200 may be positioned such that the landing shoulder 10 sits inside the outer tubular 100. It should be appreciated that each protrusion 30 of FIGS. 3-8 may have any suitable geometry for contact, such as for example a square, a circle, an oval, a trapezoid, a T-shape, an irregular shape, and so forth. Additionally, it should be noted that each protrusion 30 of FIGS. 3-8 may include faces or portions that are curved, flat, tapered, grooved (e.g., including bumps, protrusions, indentations, recesses, or similar features) or any combination thereof. One or more of the protrusions 30 may be annularly shaped with a constant radius (e.g., straight, cylindrical shaped). In certain embodiments, one or more of the protrusions 30 may have a variable radius (e.g., linearly changing radius to define conical geometry or a curvilinear changing radius to define a curved annular shape).

In operation, the inner tubular 200 is lowered into the outer tubular 100. As the inner tubular 200 is lowered, a first radial contact on the outer surface of the inner tubular, such as a tapered landing shoulder 10 or a protrusion 30, contacts an inner surface of the outer tubular. In embodiments (including those illustrated in FIGS. 3 and 5), upon additional lowering, the lock mechanism 50 allows for setting of the tapered landing shoulder 10 within the inner tubular 200. In other embodiments (including those illustrated in FIG. 7), upon additional lowering, a second radial contact on the outer surface of the inner tubular 200, such as a tapered landing shoulder 10 or a protrusion 30, contacts an inner surface of the outer tubular 100. Once the radial contacts are established, the lock mechanism 50 secures the inner tubular 200 to the outer tubular 100.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A load transfer profile for connecting an inner axial body having a radius and an outer axial body, comprising:

a lower radial contact on the inner axial body, wherein the lower radial contact is a protrusion;

an upper radial contact on the inner axial body, wherein the upper radial contact comprises a tapered landing shoulder and a stop shoulder, the stop shoulder is between the tapered landing shoulder and the lower radial contact, the tapered landing shoulder and the stop shoulder are both configured to contact corresponding surfaces on the outer axial body, the upper radial contact is axially separated from the lower radial contact by an axial distance, and the load transfer profile has a radial gap extending over an entirety of the axial distance between the lower radial contact and the stop shoulder of the upper radial contact;

wherein the lower radial contact is configured to receive a horizontal force;

wherein the upper radial contact is configured to receive a substantially equal horizontal force in an opposite direction; and wherein the axial distance is greater than the radius of the inner axial body.

2. The load transfer profile of claim 1, further comprising a locking mechanism separate from the upper radial contact and lower radial contact.

3. The load transfer profile of claim 1, wherein the upper radial contact and the lower radial contact are cylindrical.

4. The load transfer profile of claim 1, wherein the upper radial contact is substantially parallel to the lower radial contact.

5. The load transfer profile of claim 1, wherein the radial gap comprises an annular volume.

6. The load transfer profile of claim 1, wherein the radial gap between the inner axial body and the outer axial body is less than 1% of the axial distance between the upper radial contact and the lower radial contact.

7. The load transfer profile of claim 1, wherein the axial distance between the upper radial contact and the lower radial contact is approximately 0.457 meters to 1.524 meters.

8. The load transfer profile of claim 1, wherein a first radial thickness at a first center point of the upper radial contact and a second radial thickness at a second center point of the lower radial contact is at least 20% of the axial distance between the upper radial contact and the lower radial contact.

9. The load transfer profile of claim 1, comprising a lock mechanism, wherein the tapered landing shoulder and stop shoulder are between the lock mechanism and the radial gap.

10. A load transfer assembly configured to be coupled to a subsea wellhead housing disposed within a conductor housing, the load transfer assembly comprising:

an inner tubular comprising an inner axial body having a radius and a lower radial contact and an upper radial contact on the inner axial body, wherein the lower radial contact and the upper radial contact comprise protrusions, and wherein a first length of the lower radial contact is greater than a second length of the upper radial contact along a longitudinal axis of the inner tubular;

an outer tubular comprising an outer axial body wherein the inner and outer tubulars are radially separated by a first radial gap extending over an entirety of an axial distance between the lower radial contact and the upper radial contact and a second radial gap between the upper radial contact and a landing shoulder, wherein the outer tubular is straight between the landing shoulder and lower radial contact, and wherein a width between the inner tubular and the outer tubular that defines the first radial gap is substantially the same between the upper radial contact and the lower radial contact;

wherein the lower radial contact is configured to receive a first lateral force relative to a central axis of the inner tubular;

wherein the upper radial contact is configured to receive a second lateral force that is substantially equal to the first lateral force in an opposite direction; and wherein the axial distance is greater than the radius of the inner axial body.

11. The load transfer assembly of claim 10, wherein the upper radial contact is substantially parallel to the lower radial contact.

12. The load transfer assembly of claim 10, wherein a first radial thickness at a first center point of the upper radial contact and a second radial thickness at a second center point of the lower radial contact is at least 20% of the axial distance between the upper radial contact and the lower radial contact.

13. The load transfer assembly of claim 10, wherein the first radial gap between the inner axial body and the outer axial body is less than 1% of the axial distance between the upper radial contact and the lower radial contact.

14. The load transfer assembly of claim 10, wherein the first radial gap comprises an annular volume.

15. The load transfer assembly of claim 10, comprising a locking mechanism.

16. The load transfer assembly of claim 15, wherein the landing shoulder is between the locking mechanism and the upper radial contact.

* * * * *